US010774568B2

(12) United States Patent
Saitou et al.

(10) Patent No.: US 10,774,568 B2
(45) Date of Patent: Sep. 15, 2020

(54) OUTER HANDLE DEVICE FOR VEHICLE DOOR

(71) Applicant: KABUSHIKI KAISHA HONDA LOCK, Miyazaki-Shi, Miyazaki (JP)

(72) Inventors: Yasuhiro Saitou, Miyazaki (JP); Tatsuya Ooyama, Miyazaki (JP); Kazuki Moro, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 56 days.

(21) Appl. No.: 16/172,046

(22) Filed: Oct. 26, 2018

(65) Prior Publication Data

US 2020/0071968 A1 Mar. 5, 2020

(30) Foreign Application Priority Data

Aug. 30, 2018 (JP) ..... 2018-161240

(51) Int. Cl.
*E05B 79/08* (2014.01)
*E05B 85/14* (2014.01)
*E05B 85/06* (2014.01)

(52) U.S. Cl.
CPC ..... *E05B 79/08* (2013.01); *E05B 85/06* (2013.01); *E05B 85/14* (2013.01); *E05Y 2900/531* (2013.01)

(58) Field of Classification Search
CPC ..... E05B 79/08; E05B 79/04; E05B 79/06; E05B 85/06; E05B 5/14; E05B 79/12; E05Y 2900/531
(Continued)

(56) References Cited

U.S. PATENT DOCUMENTS 2,131,033 A * 9/1938 Barrington ..... E05B 85/107 70/208
6,240,755 B1 * 6/2001 Da Silva ..... E05B 17/186 292/336.3
(Continued)

FOREIGN PATENT DOCUMENTS

JP 2001-123713 A 5/2001
JP 3563632 B2 9/2004
(Continued)

OTHER PUBLICATIONS

Official Communication, International Search Report with Written Opinion, from a corresponding International Application, PCT/JP2018/044924, dated Feb. 12, 2019.

*Primary Examiner* — Lloyd A Gall
(74) *Attorney, Agent, or Firm* — Carrier Blackman & Associates, P.C.; William D. Blackman; Joseph P. Carrier

(57) ABSTRACT

In an outer handle device for a vehicle door, a cylinder lock having a key hole is mounted on an handle base in an attitude in which the cylinder lock is inclined downward or upward in going outward in a vehicle width direction while the key hole is made to face an outside when an operating handle is in an operated position but the key hole is covered by an handle main body when the operating handle is in a non-operated position. A provisional holding device is provided between the handle base and the cylinder lock, provisionally holds a mounted position and a mounted attitude of the cylinder lock with respect to the handle base, and is formed to guide the cylinder lock inserted into an insertion hole provided in the handle base so that the cylinder lock attains the mounted attitude at the mounted position.

3 Claims, 11 Drawing Sheets

(58) Field of Classification Search
USPC ..... 70/423–428, 455, 208, 210, 370, 371, 70/451, 466; 292/336.3
See application file for complete search history.

(56) References Cited

U.S. PATENT DOCUMENTS

| | | | | |
|---|---|---|---|---|
| 8,146,393 | B2 * | 4/2012 | Katagiri ..... | E05B 17/18 292/336.3 |
| 8,959,964 | B2 * | 2/2015 | Hidaka ..... | E05B 79/06 292/336.3 |
| 2014/0167433 | A1 | 6/2014 | Gerber | |
| 2015/0345179 | A1 | 12/2015 | Kushida et al. | |
| 2017/0002589 | A1 * | 1/2017 | Toyama ..... | E05B 85/16 |

FOREIGN PATENT DOCUMENTS

| | | | |
|---|---|---|---|
| JP | 2007-314956 | A | 12/2007 |
| JP | 2014-198939 | A | 10/2014 |
| JP | 2015/227585 | A | 12/2015 |
| JP | 2016-199937 | A | 12/2016 |
| WO | WO 2014/155176 | A1 * | 10/2014 |

* cited by examiner 11A
11B
7
7
UP
DOWN
OUTSIDE
INSIDE
19
24
31
33
42
44
45
46
47
48
54
56
57
58

7
7
19
24
31
32
32c
33
34
35
39
39b
39c
39d
42
43
47
48
50
51
52
55

OUTER HANDLE DEVICE FOR VEHICLE DOOR

CROSS REFERENCE TO RELATED APPLICATIONS

The present application claims priority under 35 U.S.C. § 119 to Japanese Patent Application No. 2018-161240 filed Aug. 30, 2018, the entire contents of which are hereby incorporated by reference.

BACKGROUND OF THE INVENTION

Field of the Invention

The present invention relates to an outer handle device for a vehicle door in which an operating handle having a handle main body disposed on an outer face side of an outer panel of the vehicle door is disposed on the vehicle door, the handle main body being capable of pivoting between a non-operated position and an operated position, a handle base is mounted on the outer panel, a cylinder lock having a key hole is mounted on the handle base in an attitude in which the cylinder lock is inclined downward or upward in going outward in a vehicle width direction while the key hole is made to face an outside when the operating handle is in the operated position but the key hole is covered by the handle main body when the operating handle is in the non-operated position, and a provisional holding device is provided between the handle base and the cylinder lock, the provisional holding device provisionally holding a mounted position and a mounted attitude of the cylinder lock with respect to the handle base before mounting the cylinder lock on the handle base.

Description of the Related Art

An outer handle for a vehicle door in which a cylinder lock is mounted on a handle base in an inclined manner so as to be positioned downward in going outward in the vehicle width direction, and a key hole of the cylinder lock faces the outside when a handle main body is in an operated position is known from Japanese Patent Application Laid-open No. 2014-198939. Furthermore, an outer handle device for a vehicle door in which a cylinder lock, which is not inclined, is mounted on a handle base is known from Japanese Patent No. 3563632.

Since the outer handle device disclosed in Japanese Patent Application Laid-open No. 2014-198939 does not have a function of provisionally holding the cylinder lock when mounting the cylinder lock on the handle base, it is necessary for an operator to manually hold the cylinder lock, which is in an inclined state, at the time of mounting, and the ease of mounting is poor. On the other hand, in the arrangement disclosed in Japanese Patent No. 3563632, the outer handle device has a function of provisionally holding the cylinder lock, and when this technique is used it is unnecessary for an operator to manually hold the cylinder lock, which is in an inclined state, at the time of mounting, thus improving the ease of mounting. In order to further improve the ease of mounting, it is desirable for the outer handle device to have a guiding function when inserting the cylinder lock into the handle base in an inclined state until it attains a mounted attitude, but it is also desirable to avoid any complication of the structure due to a guiding structure being formed in addition to the provisional holding structure.

SUMMARY OF THE INVENTION

The present invention has been accomplished in light of such circumstances, and it is an object thereof to provide an outer handle device for a vehicle door that enables complication of its structure to be avoided while enabling both insertion guiding for a cylinder lock and provisional holding of the cylinder lock when mounting the cylinder lock on a handle base.

In order to achieve the object, according to a first aspect of the present invention, there is provided an outer handle device for a vehicle door in which an operating handle having a handle main body disposed on an outer face side of an outer panel of the vehicle door is disposed on the vehicle door, the handle main body being capable of pivoting between a non-operated position and an operated position, a handle base is mounted on the outer panel, a cylinder lock having a key hole is mounted on the handle base in an attitude in which the cylinder lock is inclined downward or upward in going outward in a vehicle width direction while the key hole is made to face an outside when the operating handle is in the operated position but the key hole is covered by the handle main body when the operating handle is in the non-operated position, and a provisional holding device is provided between the handle base and the cylinder lock, the provisional holding device provisionally holding a mounted position and a mounted attitude of the cylinder lock with respect to the handle base before mounting the cylinder lock on the handle base, wherein the provisional holding device is formed to guide the cylinder lock inserted into an insertion hole provided in the handle base so that the cylinder lock attains the mounted attitude at the mounted position.

In accordance with the aspect of the present invention, since the provisional holding device has a function of guiding insertion of the cylinder lock into the handle base, while simplifying the arrangement by avoiding as much as possible forming guide means in a section other than the provisional holding device, it is possible to improve the ease of mounting by enabling insertion guiding for the cylinder lock and provisional holding of the cylinder lock when mounting the cylinder lock on the handle base.

The above and other objects, characteristics and advantages of the present invention will be clear from detailed descriptions of the preferred embodiment which will be provided below while referring to the attached drawings.

DESCRIPTION OF THE PREFERRED EMBODIMENT

Figure 1:
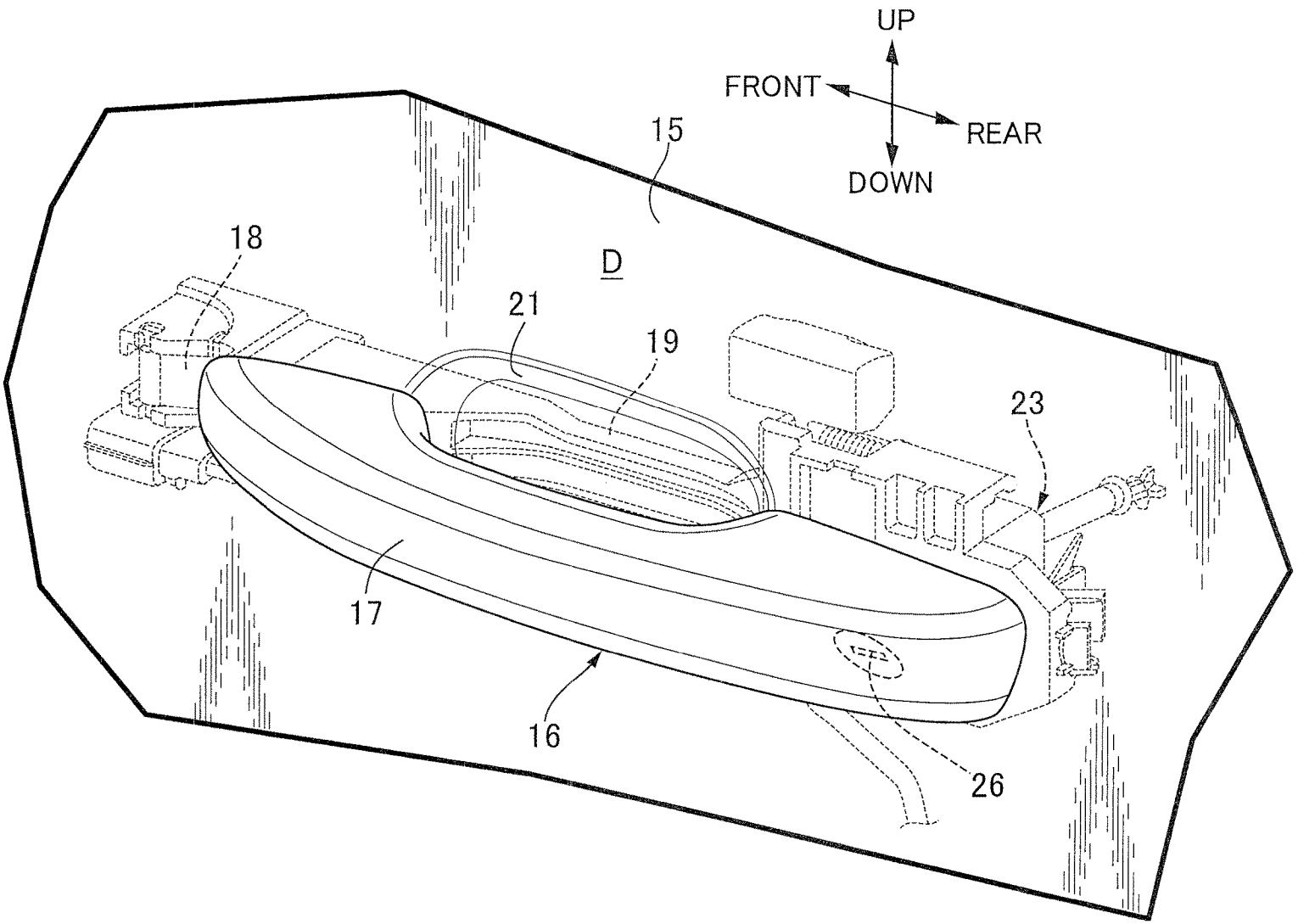
FIG. 1 is a side view of part of a vehicle door.

An embodiment of the present invention is explained below by reference to the attached FIG. 1 to FIG. 11; first, in FIG. 1, disposed on a vehicle door D, for example a side door, is an operating handle 16 that has a handle main body 17 disposed on an outer face side of an outer panel 15 of the vehicle door D and extending in the vehicle fore-and-aft direction, the operating handle 16 being capable of pivoting the handle main body 17 between a non-operated position and an operated position.

A handle base 19 extending in the vehicle fore-and-aft direction is fixed to an inner surface of the outer panel 15, and a substantially L-shaped support arm 18, provided integrally with one end part along the longitudinal direction of the handle main body 17 (a front end part in this embodiment) and projecting into the outer panel 15, is pivotably supported on a front part of the handle base 19. The handle main body 17 can thereby pivot between the non-operated position, in which the other end part thereof (a rear end part in this embodiment) is close to the outer panel 15, and the operated position, in which it is spaced from the outer panel 15, A depression 21, that is provided to enable the hand of a vehicle user gripping the handle main body 17 to be inserted therein, is formed in the outer panel 15 so as to be indented inward in the width direction.

Figure 2:
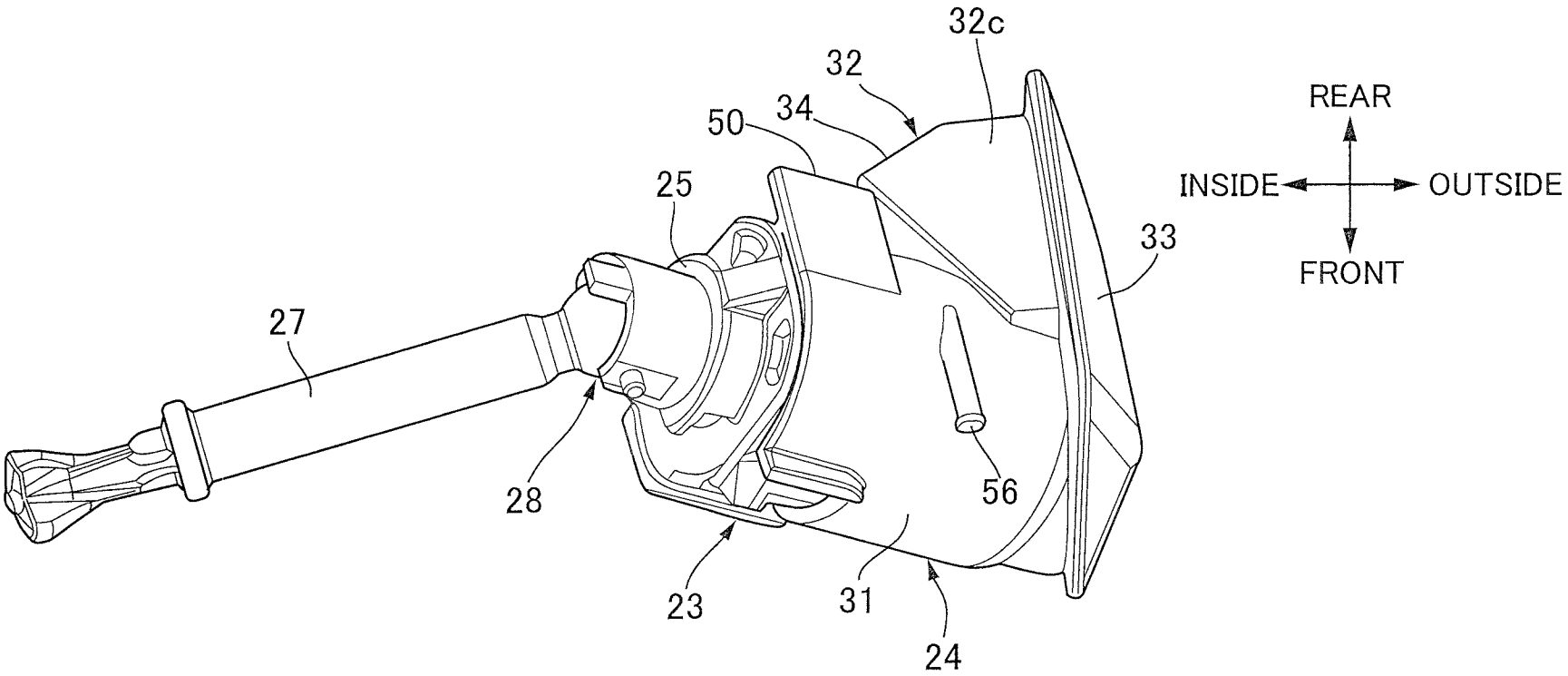
FIG. 2 is a perspective view of a cylinder lock in a state in which a rod is linked.

Referring in addition to FIG. 2, part of a rear part of the handle base 19 is disposed so as to face the outside from the outer panel 15 in a section corresponding to the other end part of the handle main body 17, and a cylinder lock 23 is mounted on the rear part of the handle base 19. The cylinder lock 23 includes a cylinder body 24 and an inner cylinder 25 pivotably inserted into the cylinder body 24, and a key hole 26 (see FIG. 1), for a mechanical key (not illustrated) to be inserted, is provided in the inner cylinder 25 so as to open on the outer face side of the handle base 19.

A rod 27 extending toward a latch mechanism (not illustrated) provided within the vehicle door D is linked, via a universal joint 28, to an end part of the inner cylinder 25 protruding from the cylinder body 24 toward the side opposite to the handle base 19. The cylinder lock 23 is configured so that during operation thereof a pivoting force, accompanying locking and unlocking operations of the cylinder lock 23, is inputted into the latch mechanism via the rod 27, and in response to the input, the latch mechanism operates so as to switch the vehicle door D between a locked state and an unlocked state.

Figure 3:
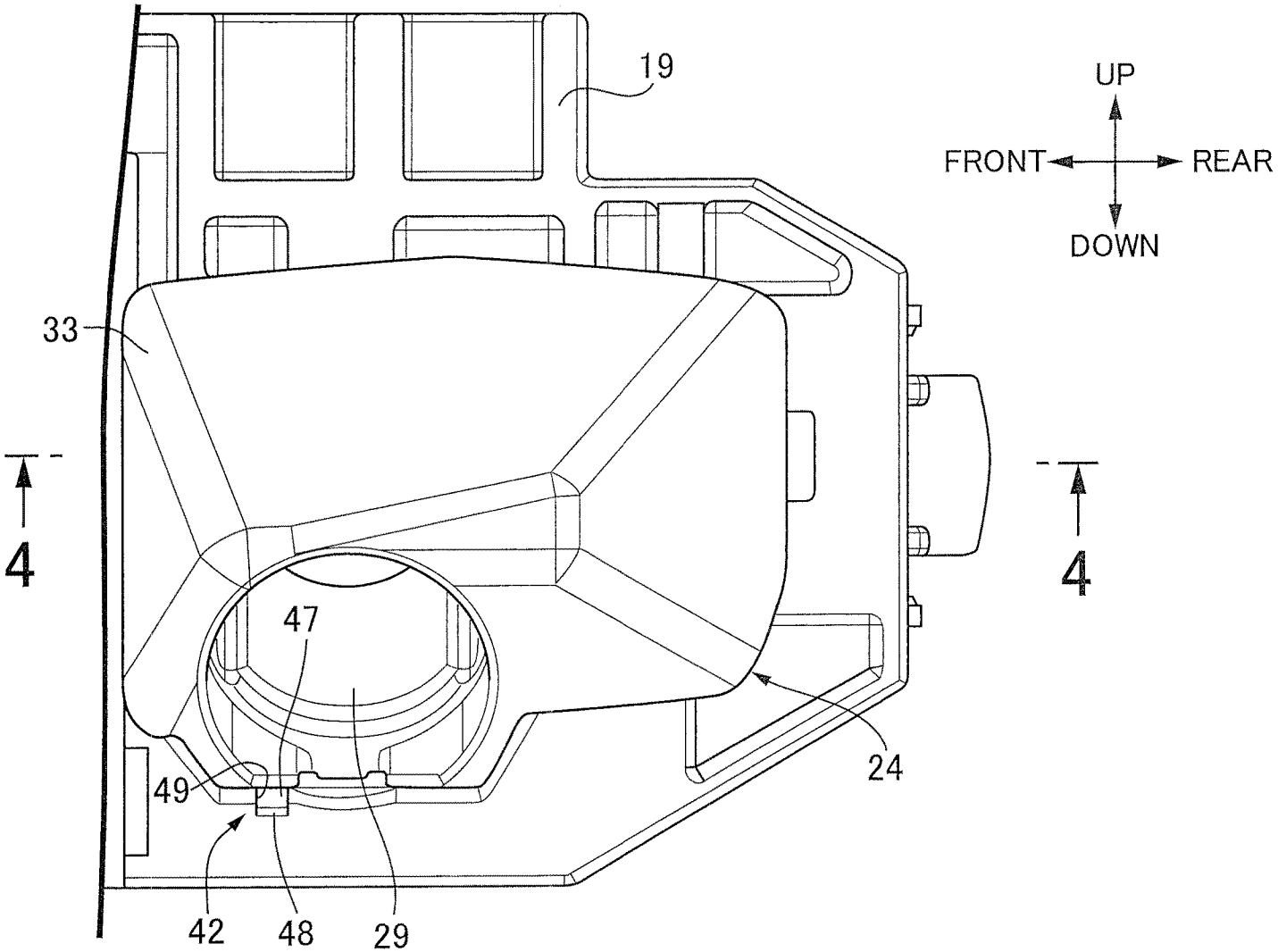
FIG. 3 is a side view showing a rear part of a handle base in a state in which a cylinder body is mounted.
Figure 4:
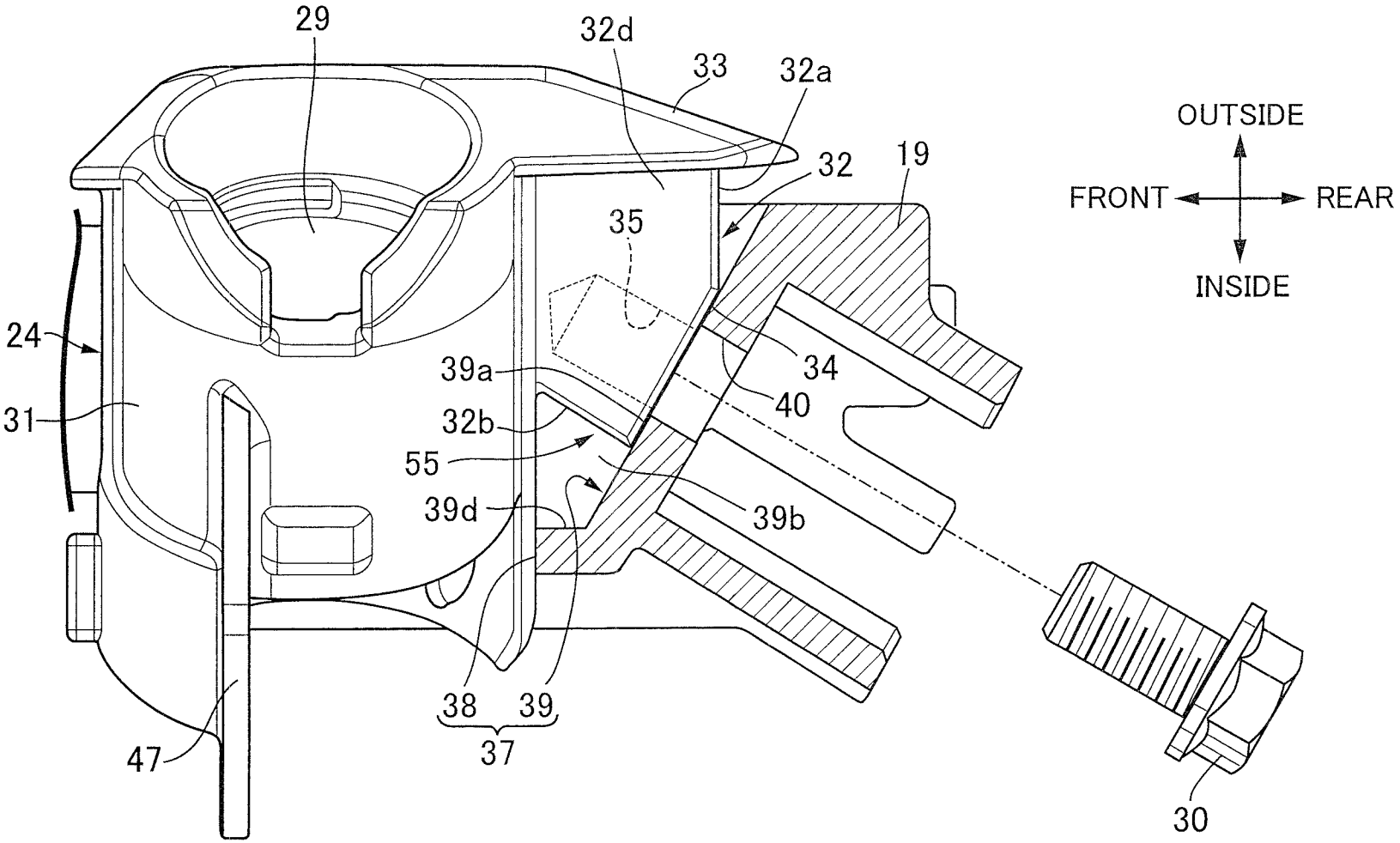
FIG. 4 is a sectional view along line 4-4 in FIG. 3.
Figure 5:
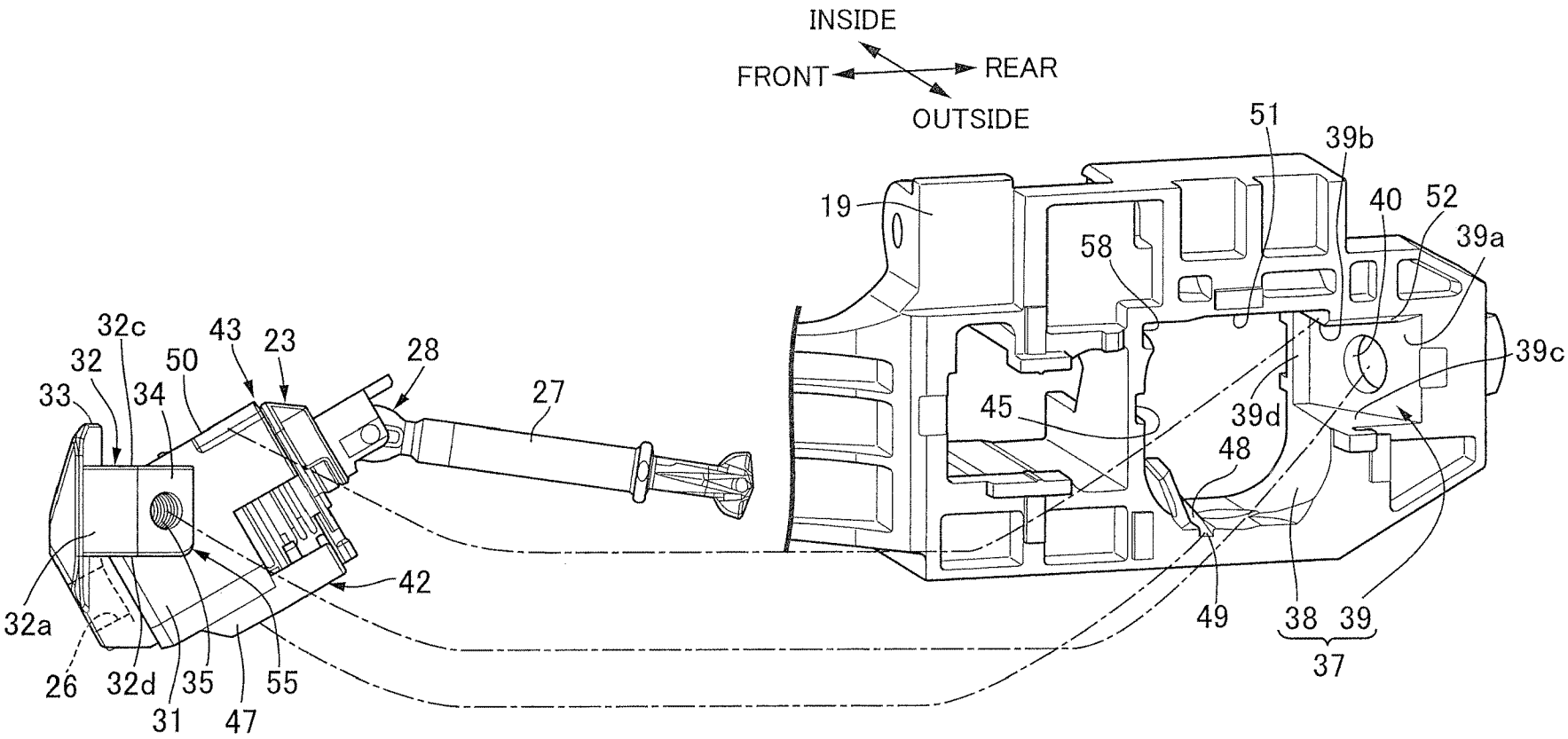
FIG. 5 is an exploded perspective view when the rear part of the handle base is viewed from the front and obliquely above and the cylinder lock is viewed from the rear.
Figure 6:
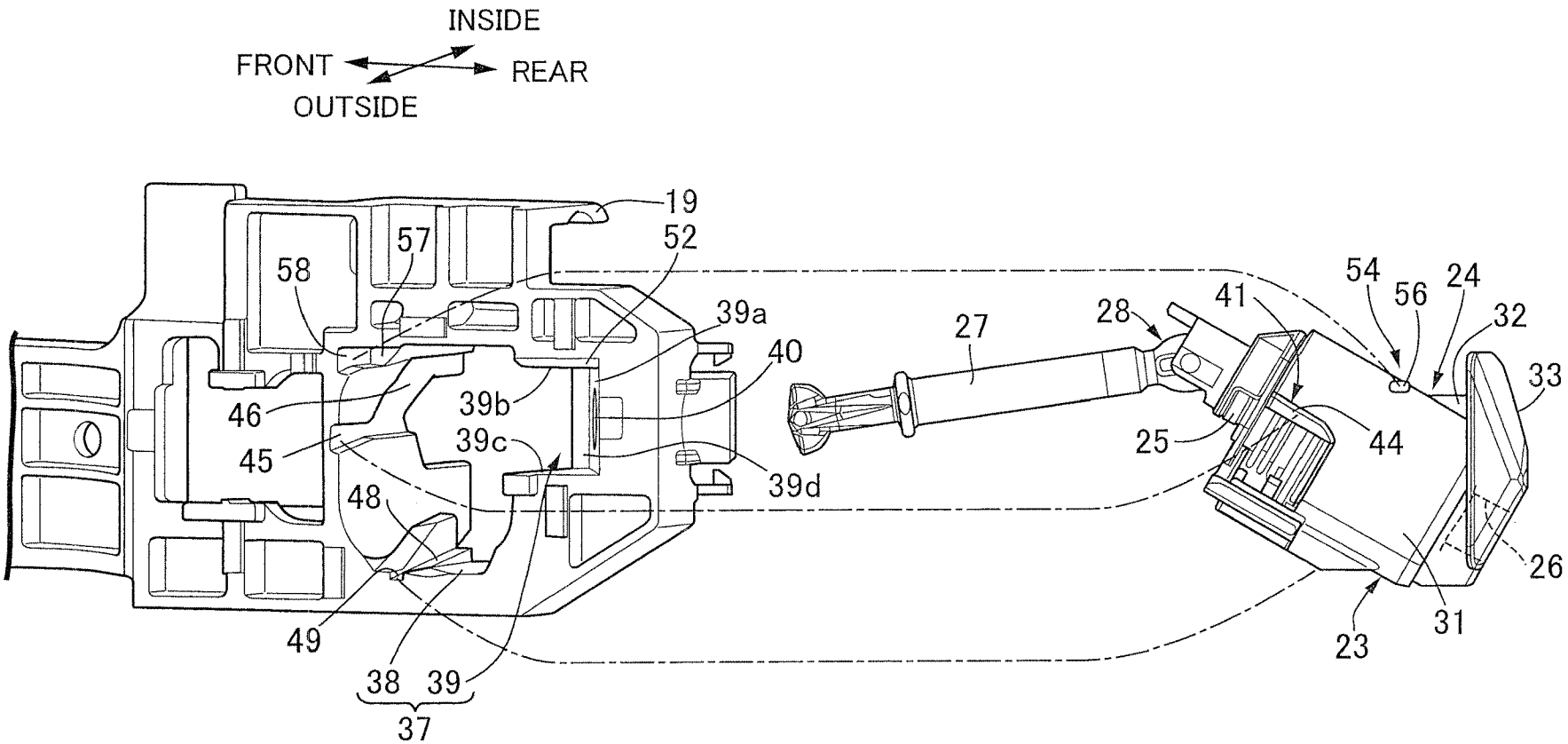
FIG. 6 is an exploded perspective view when the rear part of the handle base is viewed from the rear and obliquely above and the cylinder lock is viewed from the front.
Figure 7:
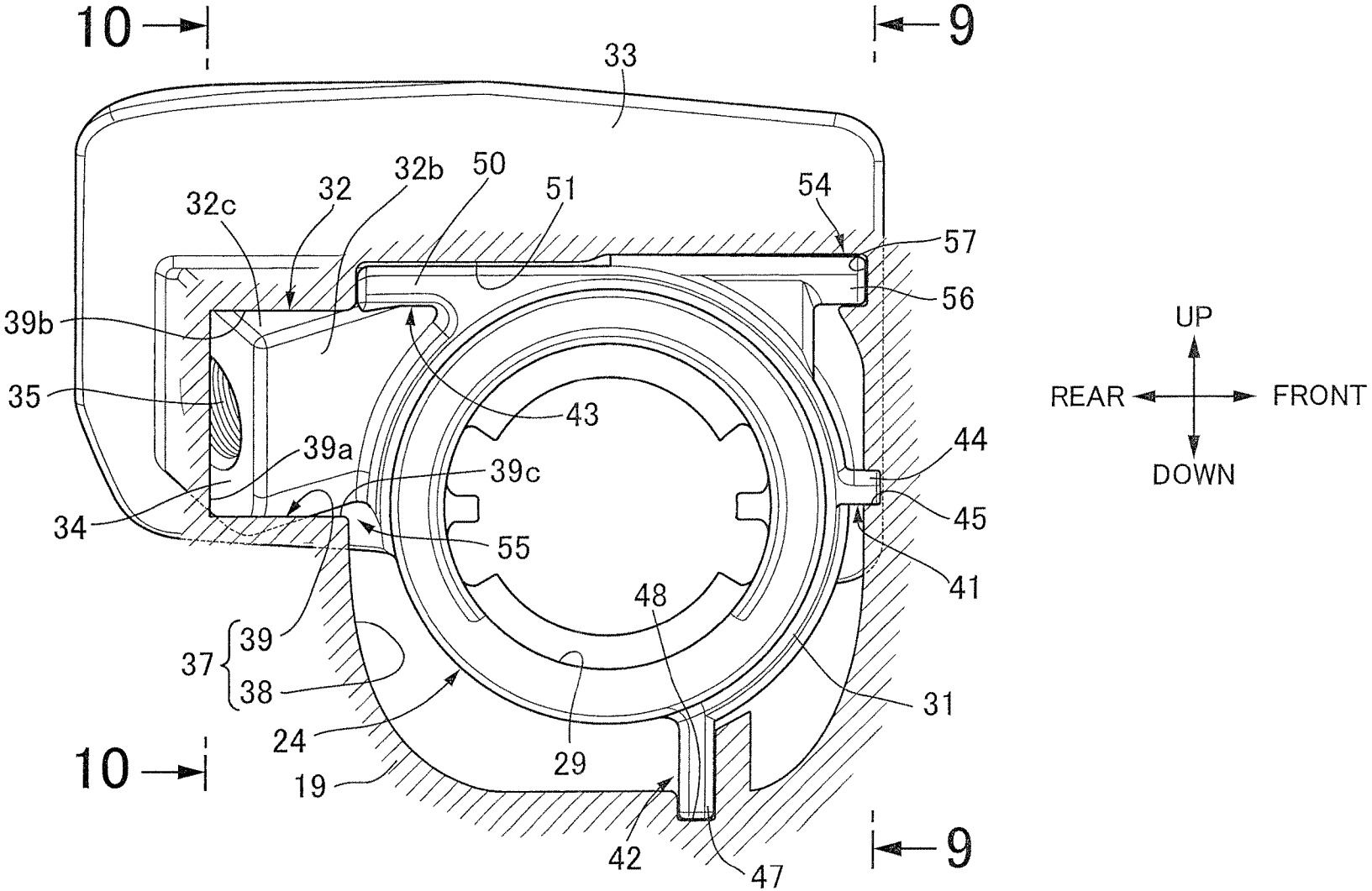
FIG. 7 is a longitudinal sectional view of the handle base and the cylinder body, which is a sectional view along line 7-7 in FIG. 9B.
Figure 8:
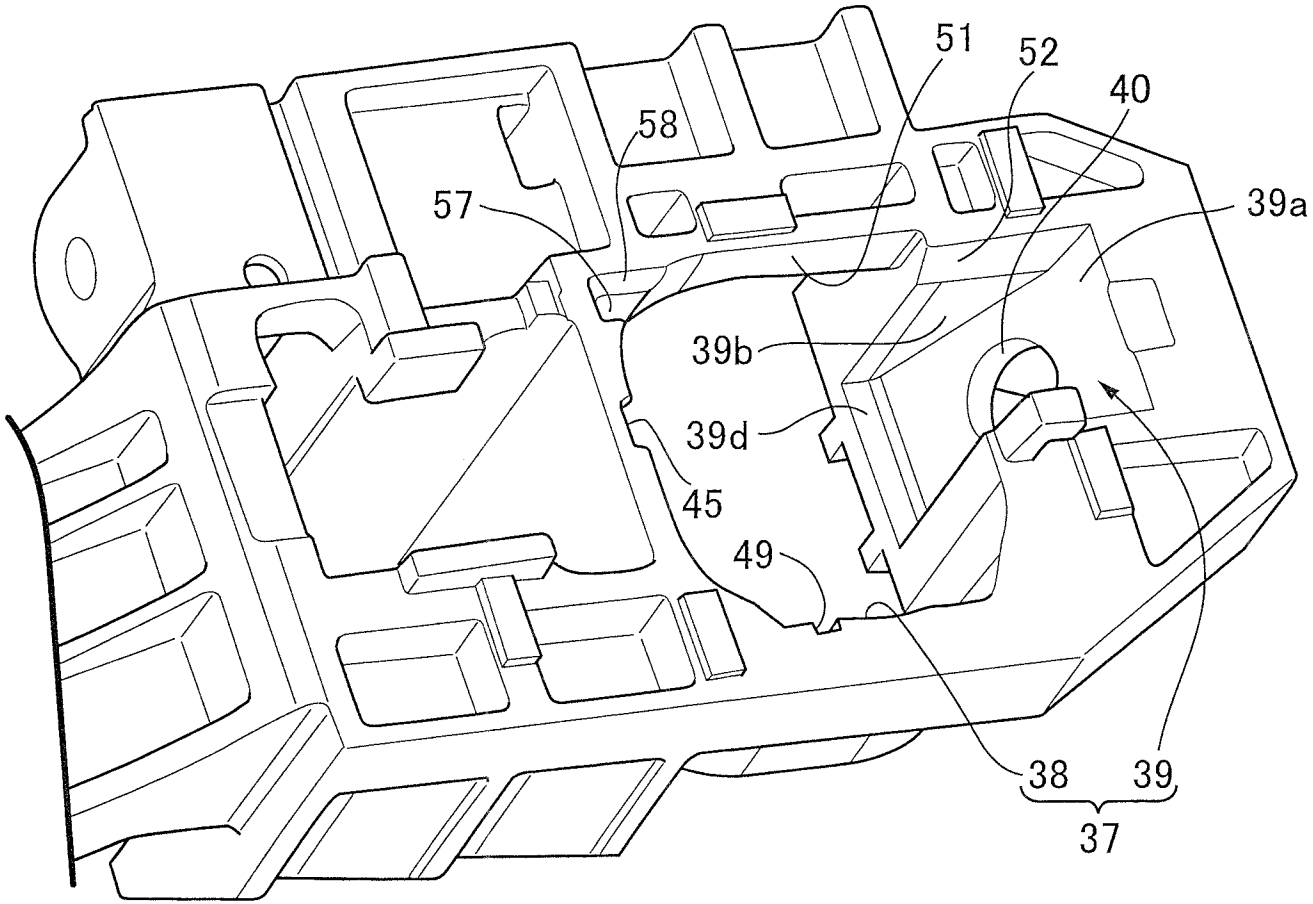
FIG. 8 is a perspective view when the rear part of the handle base is viewed from the front and obliquely below.

Referring in addition to FIG. 3 and FIG. 4, the cylinder body 24, which has a support hole 29 into which the inner cylinder 25 is pivotably fitted, is inserted into the rear part of the handle base 19 and fastened to the handle base 19 by a bolt 30. This cylinder body 24 is mounted on the handle base 19 in an attitude in which the cylinder body 24 is inclined downward or upward in going outward in the vehicle width direction while the key hole 26 is made to face the outside when the operating handle 16 is in the operated position but the key hole 26 is covered by the handle main body 17 when the operating handle 16 is in the non-operated position, and in this embodiment the cylinder body 24 is mounted on the handle base 19 in an attitude in which it is inclined downward in going outward in the vehicle width direction, that is, in an attitude in which it is inclined so that the support hole 29 is positioned downward in going outward in the vehicle width direction.

The cylinder body 24 is formed so as to integrally have a tubular body main part 31 having the support hole 29, a to-be-mounted part 32 projecting rearward from a rear part of the outer periphery on one end side of the body main part 31, and a protruding part 33 protruding sideways from one end of the body main part 31 and the to-be-mounted part 32.

The to-be-mounted part 32 is formed into a rectangular block shape while having at the tip end part a to-be-mounted face 34 that is inclined so as to be positioned forward in going inward in the vehicle width direction and is disposed further rearward than the body main part 31, and a bottomed threaded hole 35 for the bolt 30 to be screwed into is provided in the to-be-mounted face 34.

Side faces of the to-be-mounted part 32 are formed from a flat first side face 32*a* joining the upper end of the to-be-mounted face 34 and the protruding part 33 and facing rearward in the vehicle fore-and-aft direction, a second side face 32*b* joining the lower end of the to-be-mounted face 34 and the body main part 31 and facing obliquely forward and inward in the vehicle width direction, a third side face 32*c* joining upper ends of the to-be-mounted face 34, the first side face 32*a*, and the second side face 32*b* to the body main part 31 and the protruding part 33, and a fourth side face 32*d* joining lower ends of the to-be-mounted face 34, the first side face 32*a*, and the second side face 32*b* to the body main part 31 and the protruding part 33.

On the other hand, an insertion hole 37 for the cylinder body 24 to be inserted into is provided in the rear part of the handle base 19, this insertion hole 37 being formed from a through hole part 38 extending through the handle base 19 so that the body main part 31 is inserted, and a housing recess part 39 connected to a rear part of the through hole part 38 along the vehicle fore-and-aft direction so as to house the to-be-mounted part 32 and opening on an outer face of the handle base 19. The protruding part 33 of the cylinder body 24 is formed so as to cover an upper half part of the periphery of a part of the through hole part 38 opening on the outer face of the handle base 19 and the entire periphery of a part of the housing recess part 39 opening on the outer face of the handle base 19 when the cylinder body 24 is mounted on the handle base 19.

Referring in addition to FIG. 5 to FIG. 8, the housing recess part 39 has a shape corresponding to the outer face of the to-be-mounted part 32 and is formed from a support wall portion 39*a* that is inclined so as to be positioned forward in going inward in the vehicle width direction while opposing the to-be-mounted face 34 and the first side face 32*a* and that faces the through hole part 38 side, an upper wall portion 39*b* joined to the upper end of the support wall portion 39*a* at right angles so as to oppose the third side face 32*c*, a lower wall portion 39*c* joined to the lower end of the support wall portion 39*a* at right angles so as to oppose the fourth side face 32*d*, and an inner wall portion 39*d* connected to the inner end in the vehicle width direction of the support wall portion 39*a* so as to extend slightly toward the through hole part 38 side and having upper and lower ends connected to the upper wall portion 39*b* and the lower wall portion 39*c* at right angles. Formed in the support wall portion 39*a* is an insertion hole 40 through which the bolt 30 screwed into the threaded hole 35 is inserted when the to-be-mounted face 34 of the to-be-mounted part 32 abuts against the support wall portion 39*a*.

When the cylinder body 24 of the cylinder lock 23 is mounted on the handle base 19, the cylinder body 24 is inserted into the insertion hole 37 from the outside of the rear part of the handle base 19 in the vehicle width direction; upon said insertion, in a first step the cylinder body 24 is pushed in in the horizontal direction only by a predetermined distance, in a second step the cylinder body 24 is pivoted only by a predetermined angle, and in a third step the cylinder body 24 is pushed further in in the horizontal direction, thus being inserted into a mounted position.

In order to guide movement of the cylinder body 24 in the first step, for example, first to third guide means 41, 42, and 43 are provided between the cylinder body 24 and the handle base 19.

The first guide means 41 is formed from a first guide projection part 44 projectingly provided on a front part of a side wall of the body main part 31 of the cylinder body 24 close to the inner end in the vehicle width direction of the body main part 31 and extending in the longitudinal direction of the body main part 31, and a first guide groove 45 formed in a front part of the inner periphery of the through hole part 38 so that the first guide projection part 44 is slidably fitted thereinto. The first guide groove 45 has only a length that guides the first guide projection part 44 when the cylinder body 24 moves in the first step, and a side face of a lower part of the first guide groove 45 is formed in an inclined manner so as to be positioned upward in going inward in the vehicle width direction when the handle base 19 is mounted on the outer panel 15.

An escape groove 46 communicating with the inner end of the first guide groove 45 is formed in a front part of the inner periphery of the through hole part 38 so that it allows pivoting of the first guide projection part 44 when pivoting the cylinder body 24 in the second step.

The second guide means 42 is formed from a second guide projection part 47 projectingly provided on a lower part of the side wall of the body main part 31 of the cylinder body 24 close to the inner end in the vehicle width direction of the body main part 31 and extending in the longitudinal direction of the body main part 31, and a first guide face 48 formed on the lower part of the inner periphery of the through hole part 38 so that the second guide projection part 47 slidably abuts thereagainst. This first guide face 48 is formed in an inclined manner so as to be positioned upward in going inward in the vehicle width direction when the handle base 19 is mounted on the outer panel 15, while having only a length that guides the second guide projection part 47 when the cylinder body 24 moves in the first step. Moreover, part of the first guide face 48 is formed from the bottom of a recess part 49 opening on the outer face of the handle base 19.

The third guide means 43 is formed from a flat plate-shaped guide plate part 50 provided further inside in the vehicle width direction than the to-be-mounted part 32 of an upper part of a side wall of the body main part 31 of the cylinder body 24, and a second guide face 51 formed on an upper part of the inner periphery of the through hole part 38 so that the guide plate part 50 slidably abuts thereagainst. The length of the second guide face 51 in the longitudinal direction of the through hole part 38 is set at only a value that guides the guide plate part 50 when the cylinder body 24 moves in the first step. That is, of the inner periphery of the through hole part 38, an upper inner periphery, which is the second guide face 51, is formed so as to be short in the longitudinal direction of the through hole part 38, and when the cylinder body 24 is pushed in in the third step the guide plate part 50 attains a position that deviates inward in the vehicle width direction from the second guide face 51.

Pivoting of the cylinder body 24 in the second step occurs when the third side face 32*c* of the to-be-mounted part 32 abuts against an outer end part of the upper wall portion 39*b* of the housing recess part 39. Formed on the outer end part of the upper wall portion 39*b* is a pivoting guide face 52, inclined so as to be positioned downward in going inward in the vehicle width direction. This pivoting guide face 52 also functions as a stop member configured to temporarily stop and hold the cylinder lock in a first mounted position, shown in FIG. 10B. Pushing the cylinder body 24 further in to the handle base 19 from the first mounted position, in a state in which the third side face 32*c* abuts against the pivoting guide face 52, pivots the cylinder body 24 so that its outer end is oriented downward.

Furthermore, in order to provisionally hold the mounted position and mounted attitude of the cylinder body 24 with respect to the handle base 19 before mounting the cylinder body 24 on the handle base 19, for example, first and second provisional holding means 54 and 55 are provided between the cylinder body 24 and the handle base 19.

The first provisional holding means 54 is formed from a holding projection part 56 projectingly provided on an upper part of a side wall of the body main part 31 in an intermediate part in the vehicle width direction of the body main part 31 of the cylinder body 24 and projecting forward in the vehicle fore-and-aft direction, and a holding groove 57 formed in an upper part of a front part of the inner periphery of the through hole part 38 so that the holding projection part 56 is fitted thereinto. A second guide groove 58 communicating with the outer end of the holding groove 57 in the vehicle width direction is formed in the upper part of the front part of the inner periphery of the through hole part 38 so as to open on the outer face of the handle base 19.

The holding projection part 56 is formed so as to extend slightly in a direction that is angled with respect to the longitudinal direction of the body main part 31 of the cylinder body 24 so that it attains an attitude along the longitudinal direction of the holding groove 57 when the cylinder body 24 is moved in the horizontal direction in the third step but it attains an attitude angled with respect to the longitudinal direction of the holding groove 57 when the cylinder body 24 is moved in the horizontal direction in the first step. On the other hand, the second guide groove 58 is formed so as to have a width that allows the holding projection part 56, which is in the attitude angled in the longitudinal direction of the holding groove 57, to move toward the holding groove 57 side.

The second holding means 55 is formed from the to-be-mounted part 32 of the cylinder body 24, and the housing recess part 39 formed in the handle base 19 so as to house the to-be-mounted part 32.

Moreover, the first and second provisional holding means 54 and 55 also have a function of guiding movement of the cylinder body 24 in the third step, and the holding groove 57 is formed so as to have only a length that guides the holding projection part 56 fitted in the holding groove 57 when the cylinder body 24 moves in the third step.

Furthermore, in the second provisional holding means 55, the support wall portion 39*a*, the upper wall portion 39*b*, and the lower wall portion 39*c* of the housing recess part 39 guide movement of the cylinder body 24 by making the to-be-mounted face 34, the third side face 32*c*, and the fourth side face 32*d* of the to-be-mounted part 32 be in sliding contact therewith in the third step.

Figures 9A, 9B, 9C, 9D:
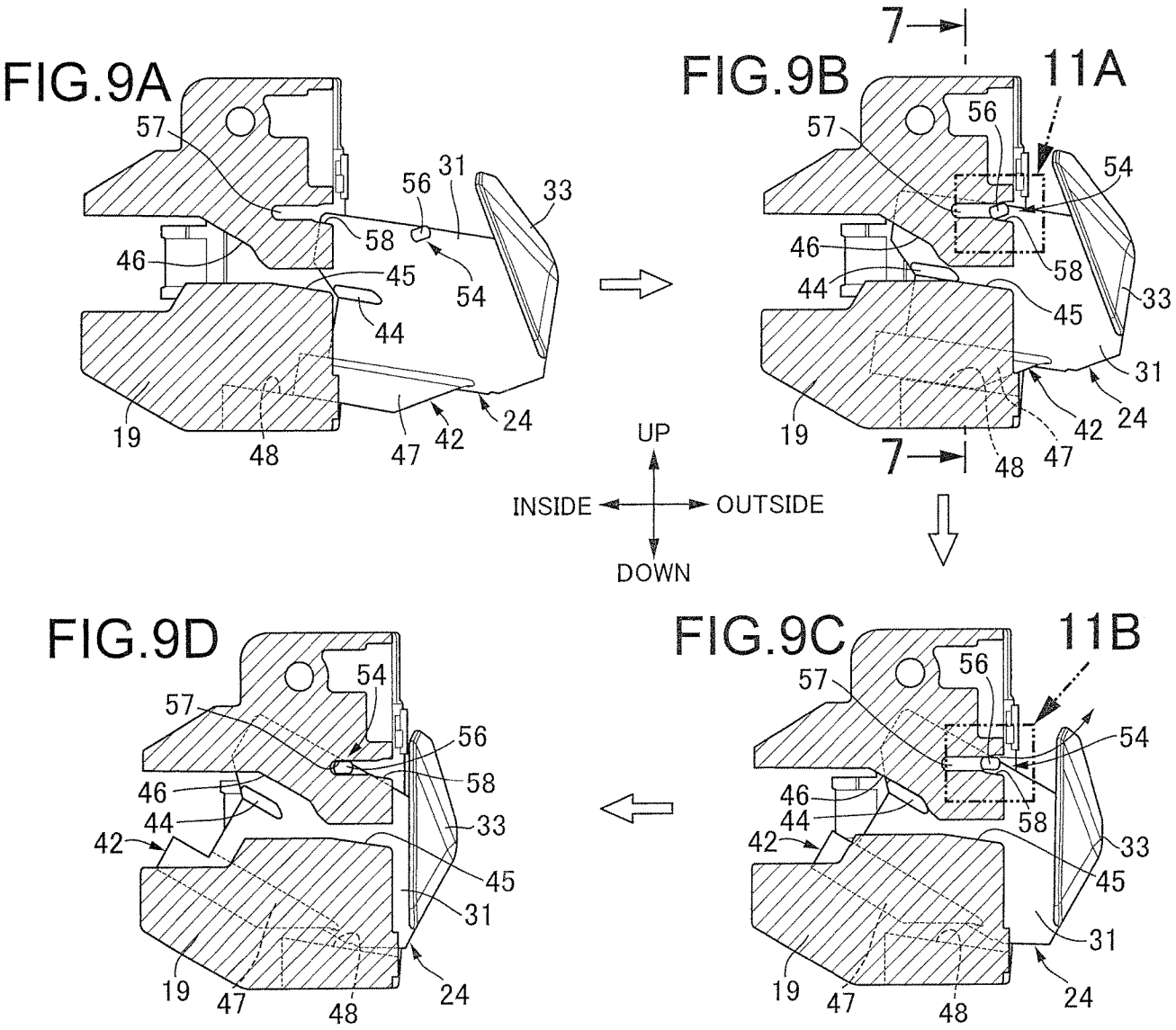
FIGS. 9A to 9D are diagrams showing the process of mounting the cylinder body on the handle base in sequence in a cross section along line 9-9 in FIG. 7.
Figures 10A, 10B, 10C, 10D:
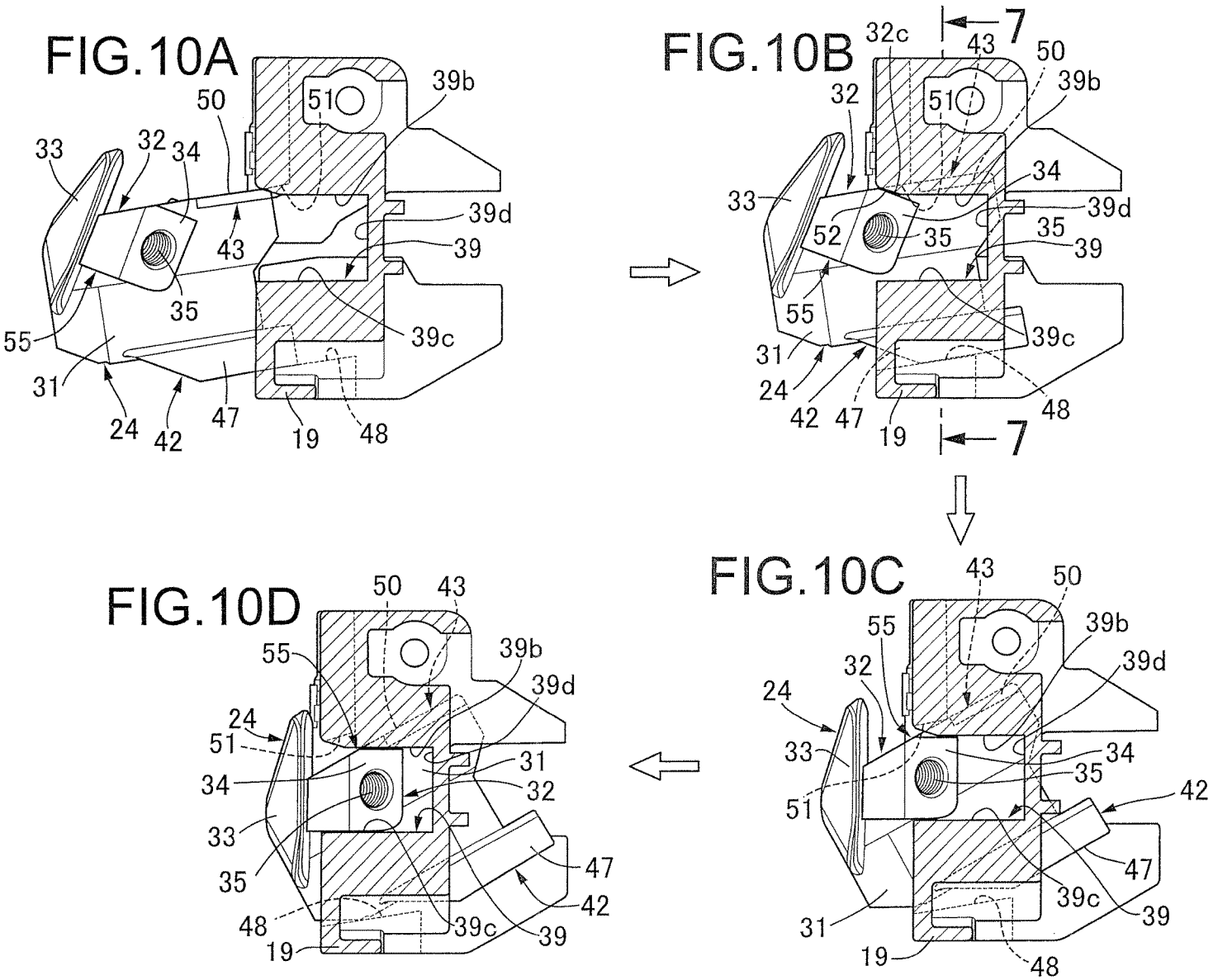
FIGS. 10A to 10D are diagrams showing the process of mounting the cylinder body on the handle base in sequence in a cross section along line 10-10 in FIG. 7.

The procedure for the operation of mounting the cylinder body 24 on the handle base 19 using the first to third guide means 41 to 43 and the first and second provisional holding means 54 and 55 is explained by reference to FIG. 9 to FIG. 11; first, in a first step the cylinder body 24 disposed outside the handle base 19 mounted on the outer panel 15 of the vehicle door D is moved toward the handle base 19 side, as shown in FIG. 9A the first guide projection part 44 of the first guide means 41 is fitted into the first guide groove 45, as shown in FIG. 9A and FIG. 10A the second guide projection part 47 of the second guide means 42 is abutted against the first guide face 48, and as shown in FIG. 10A the guide plate part 50 of the third guide means 43 is abutted against the second guide face 51. Subsequently, when the cylinder body 24 is pushed in in the horizontal direction, the first guide projection part 44 moves within the first guide groove 45, the second guide projection part 47 slides along the first guide face 48, the guide plate part 50 slides along the second guide face 51 thereby guiding movement of the cylinder body 24, and the cylinder body 24 is pushed in toward the handle base 19 side so as to move obliquely upward with respect to the handle base 19. In such a process of movement in the first step in which the cylinder body 24 moves in the horizontal direction by a predetermined distance, the holding projection part 56 of the first provisional holding means 54 is inserted into the second guide groove 58, which communicates with the outer end of the holding groove 57.

Figure 11B:
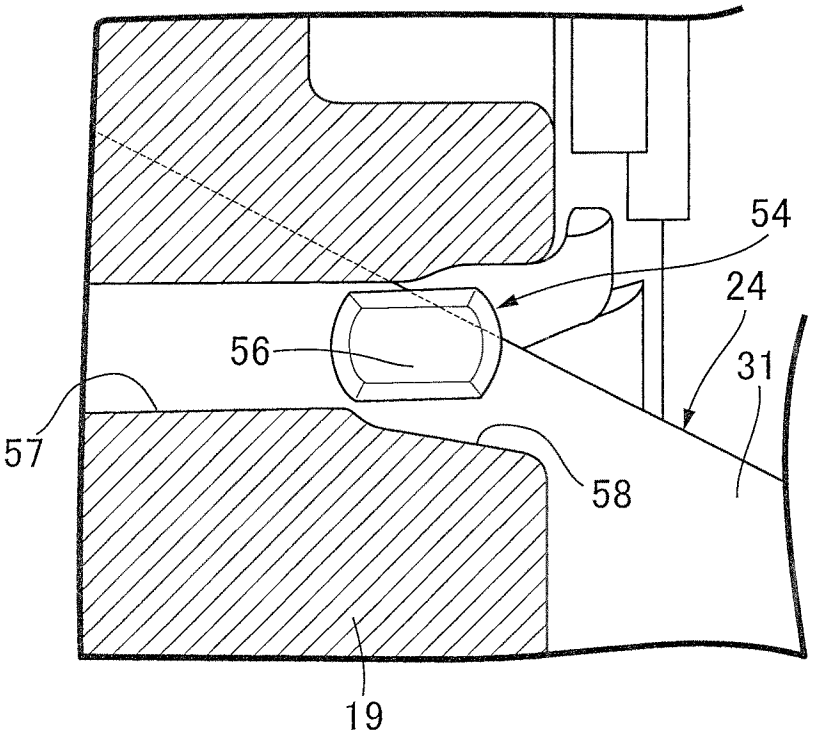
FIGS. 11A and 11B are diagrams showing a part shown by arrow 11A in FIG. 9B enlarged in FIG. 11A and a part shown by arrow 11B in FIG. 9C enlarged in FIG. 11B.
Figure 11A:
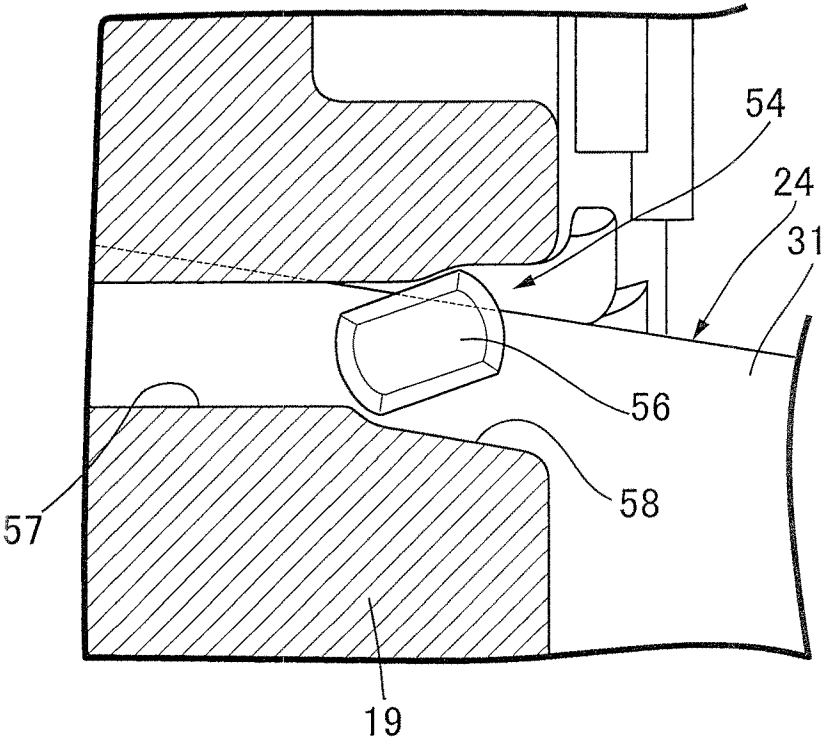

When movement of the cylinder body 24 in the first step is completed, as shown in FIG. 9B the first guide projection part 44 of the first guide means 41 is at the inner end position of the first guide groove 45 while part thereof projects into the escape groove 46, as shown in FIG. 10B the guide plate part 50 of the third guide means 43 is at a position that deviates inward in the vehicle width direction from the inner end of the second guide face 51, and as shown in FIG. 9B and FIG. 11A the holding projection part 56 of the first provisional holding means 54 is at the position of the inner end part within the second guide groove 58. Furthermore, the third side face 32*c* of the to-be-mounted part 32 of the cylinder body 24 abuts against the pivoting guide face 52 on the outer end part of the upper wall portion 39*b* of the housing recess part 39 as shown in FIG. 10B.

When the cylinder body 24 is pushed in in a second step following the first step, as shown in FIG. 9C and FIG. 10C, the cylinder body 24 pivots so that its outer end is oriented downward. In this process, the cylinder body 24 pivots with the holding projection part 56 of the first provisional holding means 54 as a pivot axis, and the holding projection part 56 thus pivoted attains an attitude in which it can be fitted into the holding groove 57 as shown in FIG. 9C and FIG. 11B, that is, an attitude along the longitudinal direction of the holding groove 57. Moreover, due to pivoting of the cylinder body 24 the first guide projection part 44 of the first guide means 41 enters the escape groove 46 as shown in FIG. 9C, the second guide projection part 47 of the second guide means 42 deviates from the first guide face 48 as shown in FIG. 9C and FIG. 10C, the guide plate part 50 of the third guide means 43 deviates from the second guide face 51 as shown in FIG. 10C, and part of the to-be-mounted part 32 of the cylinder body 24, which forms the second provisional holding means 55 together with the housing recess part 39, is fitted into the housing recess part 39 as shown in FIG. 10C.

In a third step following said pivoting of the cylinder body 24 in the second step, the cylinder body 24 is pushed further in in the horizontal direction, thus moving the holding projection part 56 of the first provisional holding means 54 within the holding groove 57 and moving the to-be-mounted part 32 of the second provisional holding means 55 within the housing recess part 39, and the cylinder body 24 is guided so that the to-be-mounted face 34 of the to-be-mounted part 32 attains a mounted position and a mounted attitude in which it abuts against the support wall portion 39*a* of the handle base 19. Furthermore, in the first provisional holding means 54, as shown in FIG. 9D the holding projection part 56 is held within the holding groove 57 so that it cannot pivot, in the second provisional holding means 55, as shown in FIG. 10D the to-be-mounted part 32 is held within the housing recess part 39 so that it cannot pivot, and the mounted position and mounted attitude of the cylinder body 24 with respect to the handle base 19 are provisionally held by the first and second provisional holding means 54 and 55 before mounting the cylinder body 24 on the handle base 19.

The operation of this embodiment is now explained; since the first and second provisional holding means 54 and 55 for provisionally holding the mounted position and mounted attitude of the cylinder body 24 of the cylinder lock 23 with respect to the handle base 19 before mounting the cylinder body 24 on the handle base 19 are provided between the handle base 19 and the cylinder body 24, and these provisional holding means 54 and 55 guide the cylinder body 24 inserted into the insertion hole 37 provided in the handle base 19 so that it attains the mounted attitude at the mounted position, it is possible to improve the ease of mounting by enabling insertion guiding of the cylinder body 24 and provisional holding of the cylinder body 24 when mounting the cylinder body 24 on the handle base 19 while simplifying the arrangement by avoiding, as much as possible, the formation of guide means in a section other than the first and second provisional holding means 54 and 55.

An embodiment of the present invention is explained above, but the present invention is not limited to the above-mentioned embodiment and may be modified in a variety of ways as long as the modifications do not depart from the gist of the present invention.

For example, in the above embodiment, a structure in which the cylinder lock 23 has the cylinder body 24, and the provisional holding means 54 and 55 are provided between the cylinder body 24 and the handle base 19 is explained, but there is a case in which a cylinder lock without a cylinder body is mounted on a handle base, and in this case the present invention may be applied to a structure in which provisional holding means is provided between an inner cylinder and the handle base.

What is claimed is:

1. An outer handle device for a vehicle door, said handle device comprising:

an operating handle having a handle main body configured to be disposed on an outer face side of an outer panel of the vehicle door, the handle main body being capable of pivoting between a non-operated position and an operated position, a handle base configured to be mounted on an inner surface of the vehicle door's outer panel, the handle base having an insertion hole formed therein, a cylinder lock having a key hole, the cylinder lock configured to be mounted on the handle base in an installed attitude in which the cylinder lock is inclined downward or upward in going outward in a vehicle width direction while the key hole is made to face an outside when the operating handle is in the operated position but the key hole is covered by the handle main body when the operating handle is in the non-operated position, and a provisional holding device provided between the handle base and the cylinder lock, the provisional holding device provided for provisionally and temporarily holding a first mounted position and a first mounted attitude of the cylinder lock with respect to the handle base during assembly and before fully mounting the cylinder lock on the handle base, the first mounted position spaced outwardly away from a fully mounted position, the provisional holding device comprising:

a first projection extending outwardly on the cylinder lock, a guide member fixed in place in the insertion hole of the handle base, the guide member configured to permit slidable movement of the first projection thereon during assembly until the cylinder lock attains the first mounted position, and a stop member configured to temporarily stop and hold the cylinder lock in the first mounted position;

wherein the provisional holding device is formed to guide the cylinder lock, inserted into the insertion hole in the handle base, to the first mounted position during assembly, and wherein the cylinder lock further has a holding projection part extending outwardly thereon, and the handle base has a holding groove formed therein to receive the holding projection part and to selectively permit slidable inward movement of the cylinder lock from the first mounted position to the fully mounted position, wherein the holding groove and the holding projection part are configured to require an angular pivotal movement of the cylinder lock in relation to the handle base in order to enable the slidable inward movement of the cylinder lock in the handle base from the first mounted position to the fully mounted position, so that the cylinder lock attains the installed attitude at the fully mounted position.

2. An outer handle device for a vehicle door, said handle device comprising:

an operating handle having a handle main body configured to be disposed on an outer face side of an outer panel of the vehicle door, the handle main body being capable of pivoting between a non-operated position and an operated position, a handle base configured to be mounted on an inner surface of the vehicle door's outer panel, the handle base having an insertion hole formed therein, a cylinder lock having a key hole, the cylinder lock configured to be mounted on the handle base in an installed attitude in which the cylinder lock is inclined downward or upward in going outward in a vehicle width direction while the key hole is made to face an outside when the operating handle is in the operated position but the key hole is covered by the handle main body when the operating handle is in the non-operated position, the cylinder lock including a tubular main body part configured for disposition inside of the vehicle door and a protruding part protruding sideways from one end of the main body part, and a provisional holding device provided between the handle base and the cylinder lock, the provisional holding device provided for provisionally and temporarily holding a first mounted position and a first mounted attitude of the cylinder lock with respect to the handle base during assembly and before fully mounting the cylinder lock on the handle base, the first mounted position spaced outwardly away from a fully mounted position, the provisional holding device comprising:

first and second projecting ribs spaced apart from one another on the main body part of the cylinder lock, first and second guide grooves formed in the insertion hole of the handle base to receive the first and second projecting ribs, the guide grooves configured to permit slidable movement of the projecting ribs therein during assembly until the cylinder lock attains the first mounted position, and a stop member configured to temporarily stop and hold the cylinder lock in the first mounted position;

wherein the provisional holding device is formed to guide the cylinder lock inserted into the insertion hole of the handle base to the first mounted position during assembly, and wherein the main body part of the cylinder lock further has a holding projection part extending outwardly thereon, and the handle base has a holding groove formed therein to receive the holding projection part and to selectively permit slidable inward movement of the cylinder lock from the first mounted position to the fully mounted position, wherein the holding groove and the holding projection part are configured to require an angular pivotal movement of the cylinder lock in relation to the handle base in order to enable the slidable inward movement of the cylinder lock in the handle base from the first mounted position to the fully mounted position, so that the cylinder lock attains the installed attitude at the fully mounted position.

3. A method of installing a lock cylinder into a handle base affixed to an outer panel of a vehicle door, said method comprising the steps of:

aligning the lock cylinder with the handle base such that a first outwardly extending projection of the lock cylinder is proximately adjacent to a guide member formed in the handle base;

sliding the lock cylinder inwardly in a first linear direction while moving the first projection of the lock cylinder along the guide member until the lock cylinder attains a first mounted position, in which a second outwardly extending projection of the lock cylinder contacts a guide groove formed in the handle base;

pivotally moving the lock cylinder in relation to the handle base by an angular amount; and sliding the lock cylinder inwardly in a second linear direction while moving the second projection of the lock cylinder along the guide groove until the lock cylinder is in a fully mounted position.

* * * * *